US005333435A

United States Patent [19]

Leek

[11] Patent Number: 5,333,435

[45] Date of Patent: Aug. 2, 1994

[54] POST TO FOUNDATION CONNECTION

[75] Inventor: William F. Leek, Anaheim, Calif.

[73] Assignee: Simpson Strong-Tie Company, Inc., San Leandro, Calif.

[21] Appl. No.: 960,784

[22] Filed: Oct. 14, 1992

[51] Int. Cl.[5] ..... E04B 1/38

[52] U.S. Cl. ..... 52/704; 52/296; 52/370; 52/712

[58] Field of Search ..... 52/169.1, 704, 712–714, 52/294–298, 370, 293.3; 403/403

[56] References Cited

U.S. PATENT DOCUMENTS

| | | | |
|---|---|---|---|
| 1,699,557 | 1/1929 | Yeager | 52/370 |
| 1,816,226 | 7/1931 | Krabiel | 52/370 |
| 2,182,579 | 12/1939 | Bolton et al. | 52/370 |
| 2,191,979 | 2/1940 | Bierbach | 52/370 |
| 3,727,358 | 4/1973 | Howell | 52/169.1 |
| 4,096,677 | 6/1978 | Gilb | 52/297 |
| 4,199,908 | 4/1980 | Teeters | 52/296 X |
| 4,614,070 | 9/1986 | Idland | 52/296 |
| 4,958,470 | 9/1990 | Han et al. | 52/296 |
| 4,995,206 | 2/1991 | Colonias et al. | 52/298 X |
| 5,143,472 | 9/1992 | Reed et al. | 52/298 X |

FOREIGN PATENT DOCUMENTS

| | | | |
|---|---|---|---|
| 103929 | 5/1938 | Australia | 52/370 |
| 481224 | 8/1929 | Fed. Rep. of Germany | 52/370 |
| 303436 | 1/1929 | United Kingdom | 52/370 |
| 453059 | 9/1936 | United Kingdom | 52/370 |

*Primary Examiner*—Peter M. Cuomo
*Assistant Examiner*—Suzanne L. Dino
*Attorney, Agent, or Firm*—James R. Cypher

[57] ABSTRACT

A post to foundation connection for joining a wood post to an anchor bolt embedded in a concrete foundation after the concrete has hardened. The post to foundation connection includes a foundation connector which is formed from a single sheet metal blank which provides post support on a pair of post support seat members raised above the top surface of the foundation and supported by at least four leg members. Uplift resistance is provided by attaching the foundation connector to the embedded anchor bolt by a nut and washer which bears against a base member formed in the foundation connector. Attachment to the post is provided by four post connection members integrally attached to the ends of the post support seat members.

6 Claims, 4 Drawing Sheets

POST TO FOUNDATION CONNECTION

BACKGROUND

This invention relates to a connection for supporting a wood post above the top surface of a concrete foundation and for securing the post to an embedded anchor bolt in the concrete foundation to provide resistance to upward movement of the post relative to the concrete foundation. Forces which could cause upward movement of the wood post include earthquakes, hurricanes, typhoons, high winds and tidal or wave forces. This invention further relates specifically to connections which are installed after the concrete foundation has hardened.

There are several types of sheet metal connectors commercially available for providing the connection described above. None, however, have been found which provide the necessary resistance to uplift and are formed from a single piece of sheet metal.

SUMMARY OF THE INVENTION

The gist of the present connection is that it consists of a single part bent from a single piece of sheet metal yet is capable of providing greater gravity load support while also providing greater resistance to uplift forces.

The present connection as a result of the one piece construction is less expensive to manufacture, less expensive to store in inventory, has no problem of missing parts at the retail distribution level, and is less expensive to install by virtue of the fact that the installer is never looking for a missing part.

An additional advantage of the present invention is the fact that the connection may be inspected even after the installation has been completed to determine whether the nut and washer have been properly installed on the threaded end of the anchor bolt.

Another advantage of the present foundation connector is the fact that the wood post does not rest on a solid plate; instead air can circulate beneath the wood post to prevent dry rot,

BRIEF DESCRIPTION OF THE DRAWINGS

FIG, 1 is a perspective view of the post to foundation connector of the present invention.

FIG. 6 also illustrates the post to foundation connection of the present invention illustrating a cross sectional portion of the foundation, a portion of the anchor bolt and washer and a portion of the wood post.

DESCRIPTION OF THE INVENTION

Figure 1:
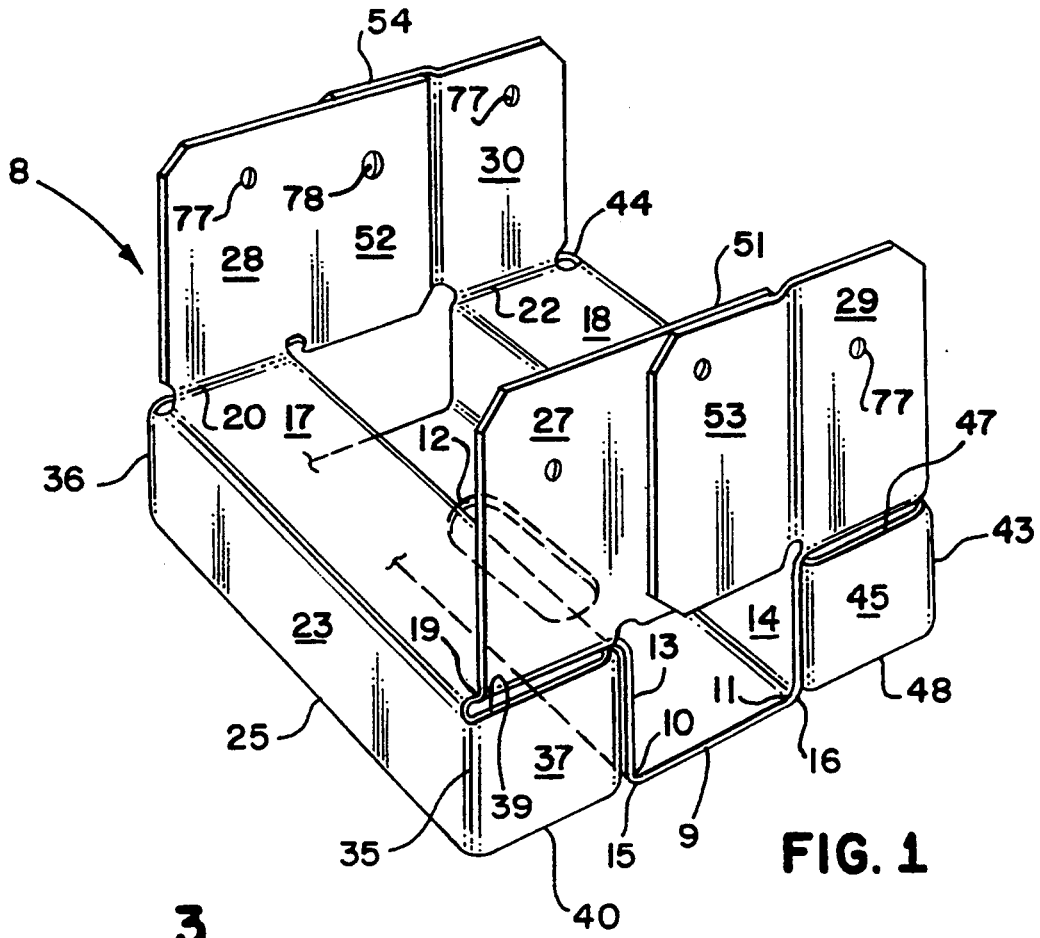
Figure 2:
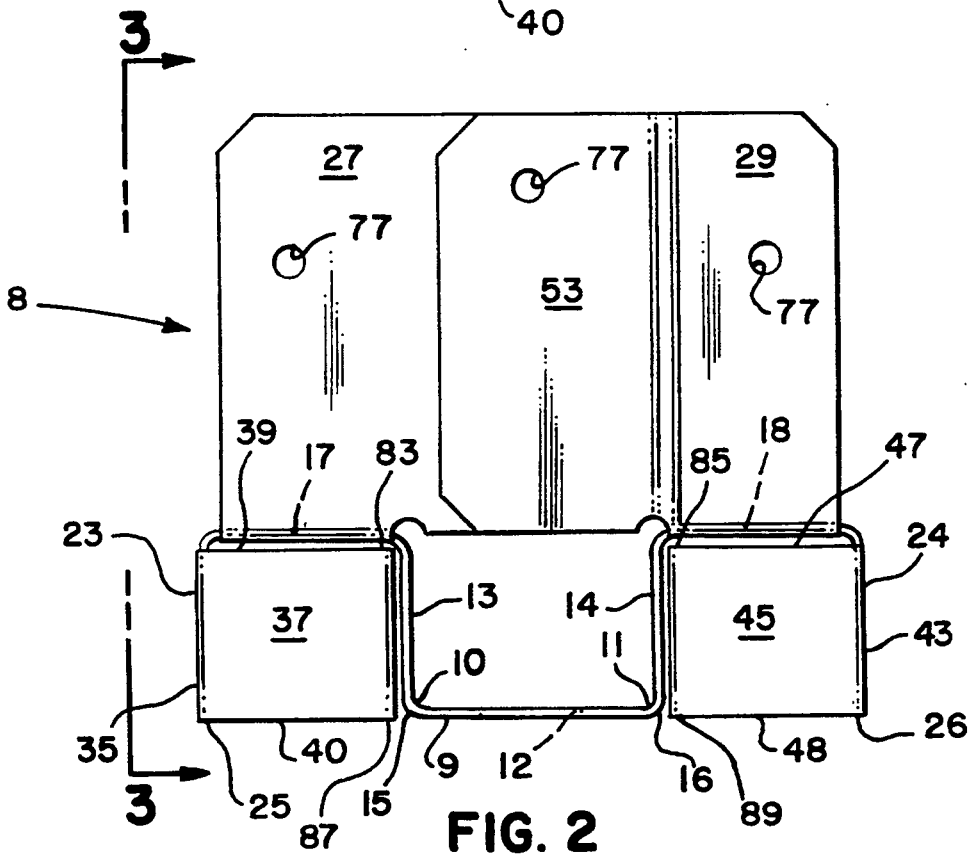
FIG. 2 is a front elevation view of the post to foundation connector illustrated in FIG. 1
Figure 3:
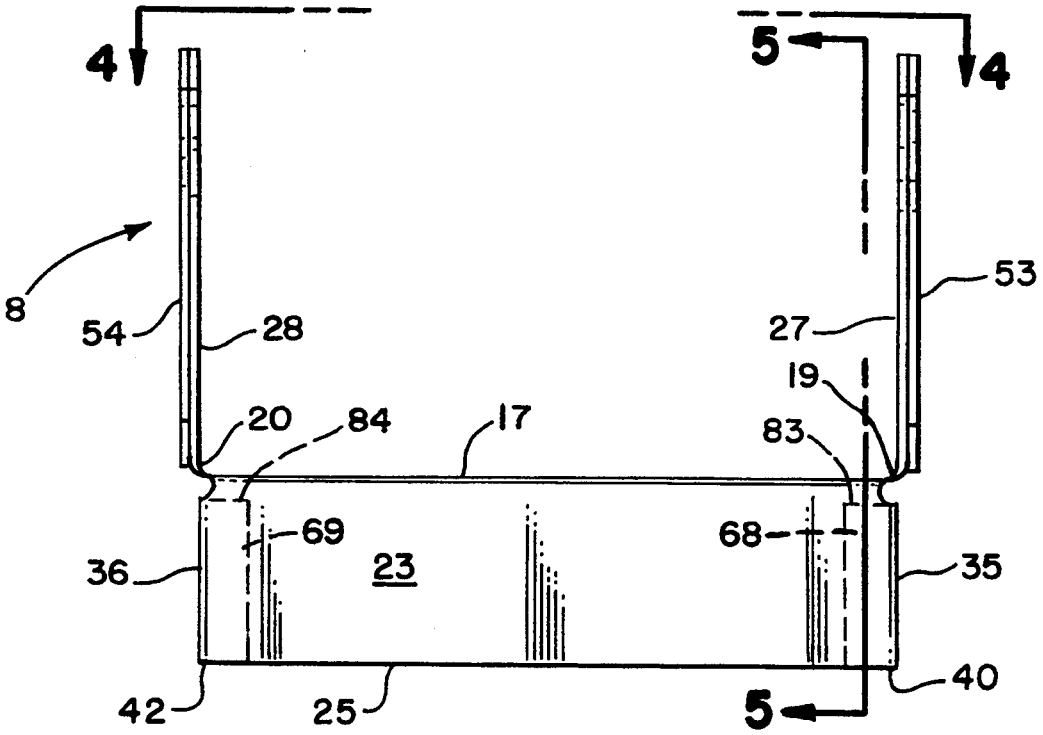
FIG. 3 is a side elevation view of the post to foundation connector illustrated in FIG. 2 and taken along line 3—3.
Figure 4:
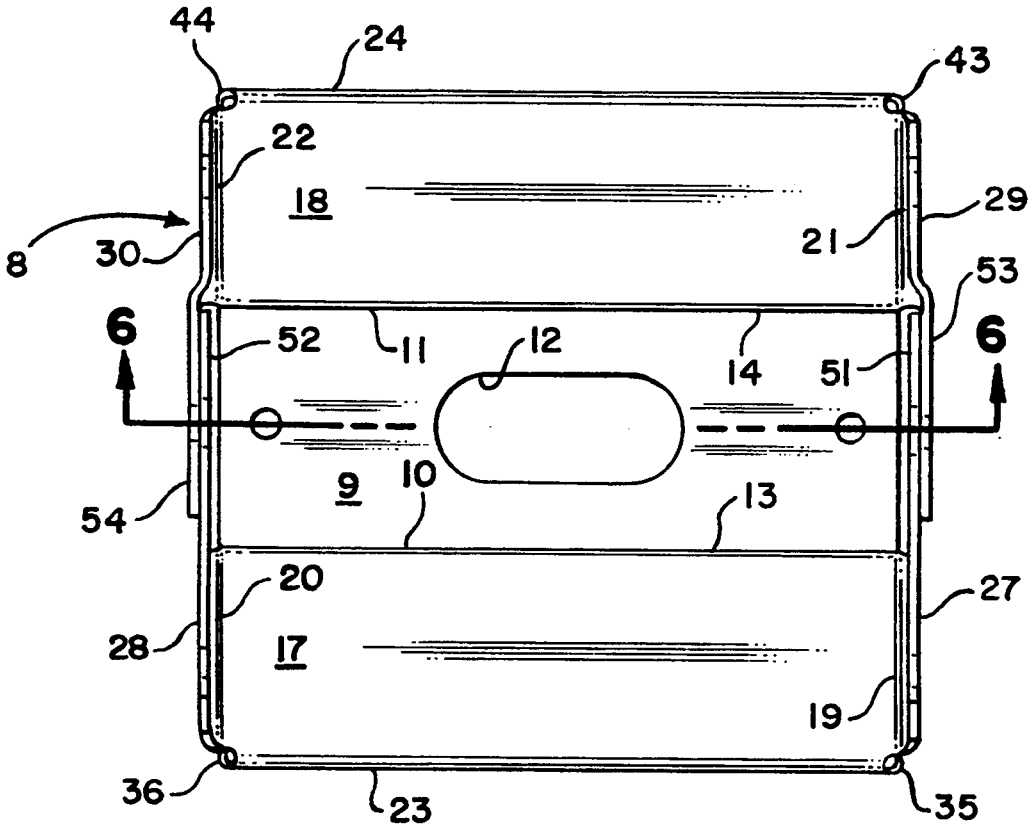
FIG. 4 is a top elevation view of the post to foundation connector illustrated in FIG. 3 and taken along line 4—4.
Figure 5:
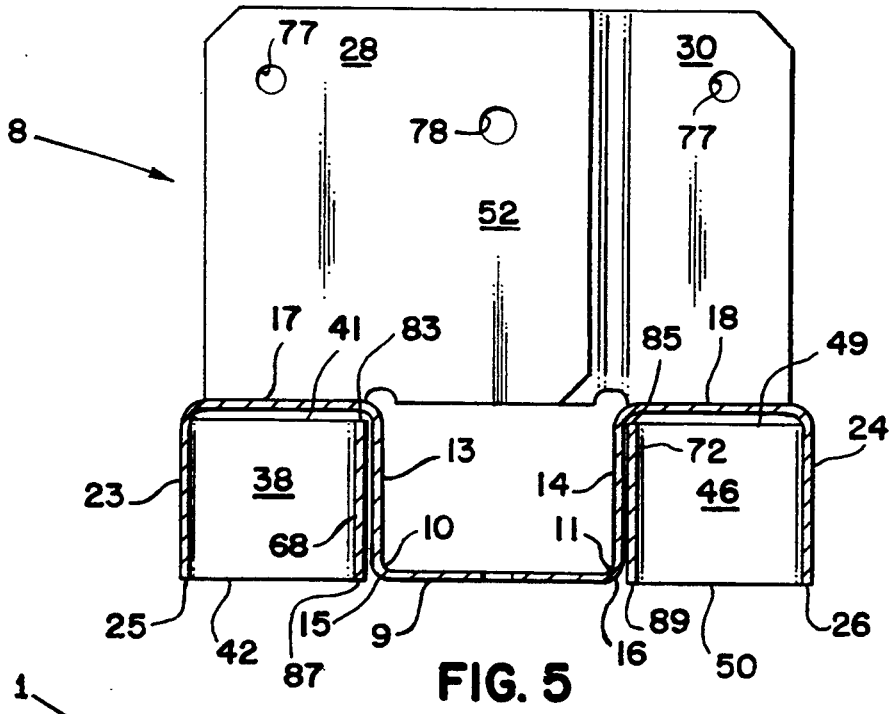
FIG. 5 is a cross sectional view of the post to foundation connector illustrated in FIG. 3 taken along line 5—5.
Figure 6:
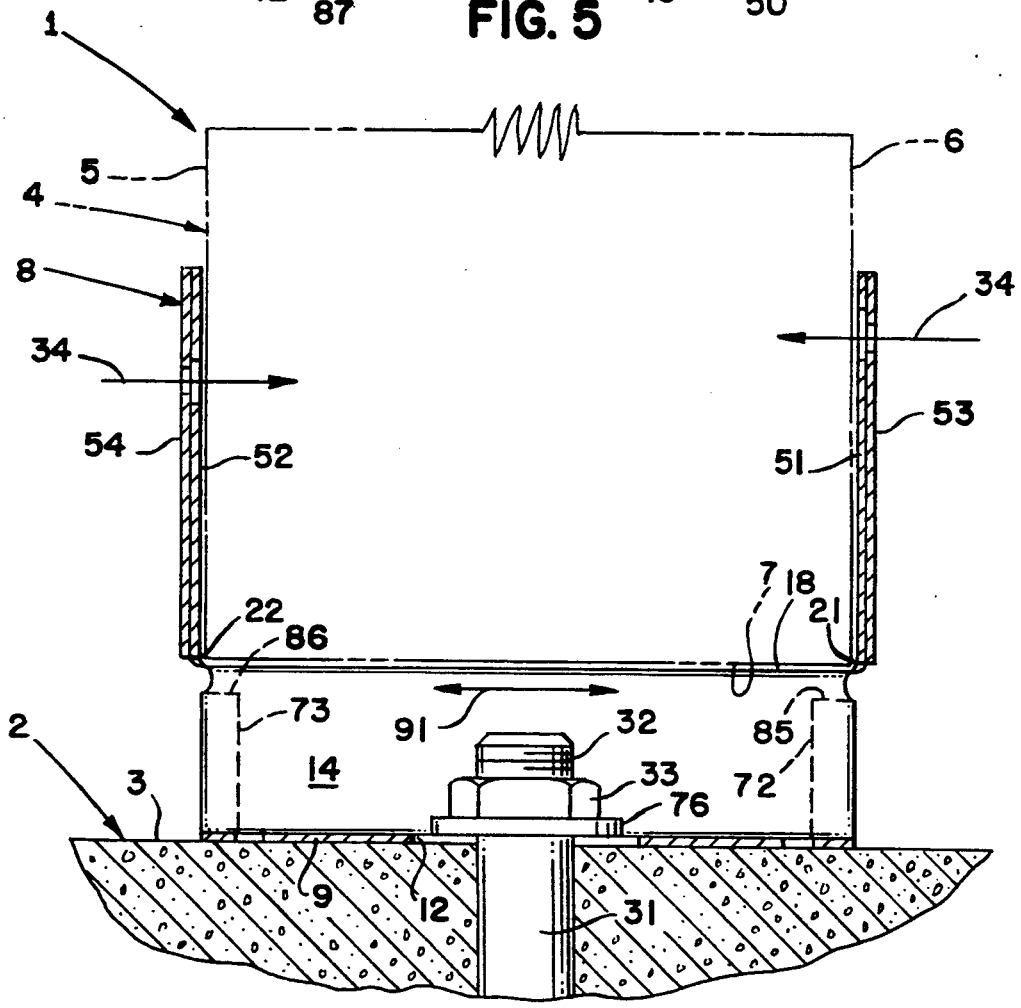
FIG. 6 is a cross sectional view of the post to foundation connector illustrated in FIG. 4 taken along line 6—6.

This invention is a post to foundation connection 1 including: a concrete foundation 2 having an upper support surface 3; a wood member 4 mounted in an upright position having first and second sides 5 and 6 and a base 7; a foundation connector 8 having: a base member 9 disposed in registration with the upper support surface 3 of the concrete foundation 2 having first and second side edges 10 and 11 and formed with a bolt opening 12, first and second inner leg members 13 and 14 joined respectively to the first and second sides edges 10 and 11 of the base member 9 and positioned in a generally upright manner providing first and second inner foot edges 15 and 16 in registration with the upper support surface 3 of the concrete foundation 2, first and second post support seat members 17 and 18 joined respectively to the first and second inner leg members 13 and 14 and disposed in registration with the base 7 of the wood member 4, and having first and second end edges 19, 20, 21, and 22, first and second outer leg members 23 and 24 joined respectively to the first and second post support seat members 17 and 18 and having first and second outer foot edges 25 and 26 in contact with the upper support surface 3 of the concrete foundation 2, first and second post connection members 27 and 28 respectively joined to the first and second end edges 19 and 20 of the first post support seat member 17 and disposed upwardly in registration respectively with the first and second sides 5 and 6 of the wood member 4, third and fourth post connection members 29 and 30 respectively joined to the first and second end edges 21 and 22 of the second post support seat member 18 and disposed upwardly in registration respectively with with the first and second sides 5 and 6 of the wood member 4, an anchor bolt 31 embedded in the concrete foundation 2 and having a threaded end 32 inserted through the bolt opening 12 in the base member 9; a threaded nut 33 dimensioned for threadable attachment to the threaded end 32 of the anchor bolt 31 for clamping registration with the base member 9; and fastener means 34 joining the first and second post connection members 27 and 28 and the third and fourth post connection members 29 and 30 to the wood member 4.

The post to foundation connection 1 as previously described may also include: the first outer leg member 23 has first and second end edges 35 and 36; first and second outer leg return members 37 and 38 joined respectively to the first and second end edges 35 and 36 of the first outer leg member 23 at an angle of at least approximately 90°; the first outer leg return member 37 is formed with an upper edge 39 positioned below and in close proximity to the first post support seat member 17 and adjacent the first end edge 19 of the first post support seat member 17, and a lower edge 40 in registration with the upper support surface 3 of the concrete foundation 2; the second outer leg return member 38 is formed with an upper edge 41 positioned below and in close proximity to the first post support seat member 17 and adjacent the second edge 20 of the first support seat member 17, and a lower edge 42 in registration with the upper support surface 3 of the concrete foundation 2; the second outer leg member 24 has first and second end edges 43 and 44; third and fourth outer leg return members 45 and 46 joined respectively to the first and second end edges 43 and 44 of the second outer leg member 24 at an angle of at least approximately 90°; the third outer leg return member 45 is formed with an upper edge 47 positioned below and in close proximity to the second post support seat member 18 and adjacent the first end edge 21 of the second post support seat member 18, and a lower edge 48 in registration with the upper support surface 3 of the concrete foundation 2; and the fourth outer leg return member 46 is formed with an upper edge 49 positioned below and in close proximity to the second post support seat member 18 and adjacent the second end edge 22 of the second post support seat member 18, and a lower edge 50 in registration with the upper support surface 3 of the concrete foundation 2.

Preferably the post to foundation connection 1 as previously described is constructed so that the first and third post connection members 27 and 29 are dimensioned so that they overlap, and the second and fourth post connection members 28 and 30 are dimensioned so that they also overlap. The forgoing may be accomplished by forming first post connection member 27 with an extension 51, second post connection member 28 is formed with an extension 52, third post connection member 29 is formed with an extension 53, and fourth post connection member 30 is formed with an extension 54.

In order for first post connection member 27 and third post connection member 29 to present a coplanar surface to second side 6 of wood member 4 an off set is formed between third post connection member 29 and extension 53 as illustrated in FIG. 1 by bending along bend lines 55 and 56. In like manner in order for fourth post connection member 30 and second post connection member and extension 52 to present a coplariat surface to first side 5 of wood member 4 an off set is formed between fourth post connection member 30 and extension 54 as illustrated in FIG. 1 by bending along bend lines 57 and 58.

A feature of the post to foundation connection 1 as described is that the identical blank 63 may be used to construct a foundation connector 8 which can be used with standard size posts or rough sawn posts which are larger dimensionally. This is achieved by providing a first end edge extension 59 joined to and coplariat with the first post support seat member 17 and extending the first end edge 19 outwardly for receiving a larger cross sectional dimension wood member. This is accomplished simply by bending first post connection member 27 upwardly along bend line 64 instead of the bend line which corresponds to first end edge 19. In like manner, a second end edge extension 60 is joined to and coplanar with the first post support seat member 17. This is achieved by a procedure in which second post connection member 28 is bent upwardly along bend line 65 instead of the bend line which corresponds to second end edge 20. Further, third post connection member 29 is bent upwardly along the bend line 66 instead of the bend line which corresponds to first end edge 21 providing a third end edge extension 61 joined to and coplanar with the second post support seat member 18 and extending first end edge 21 outwardly for receiving wood member 4.

Finally, fourth post connection member 30 is bent upwardly along bend line 67 instead of the bend line which corresponds to second end edge 22 providing fourth end edge extension 62 joined to and coplanar with the second post support seat member 18 and extending the second end edge 22 outwardly for receiving the larger wood member 4.

Figure 7:
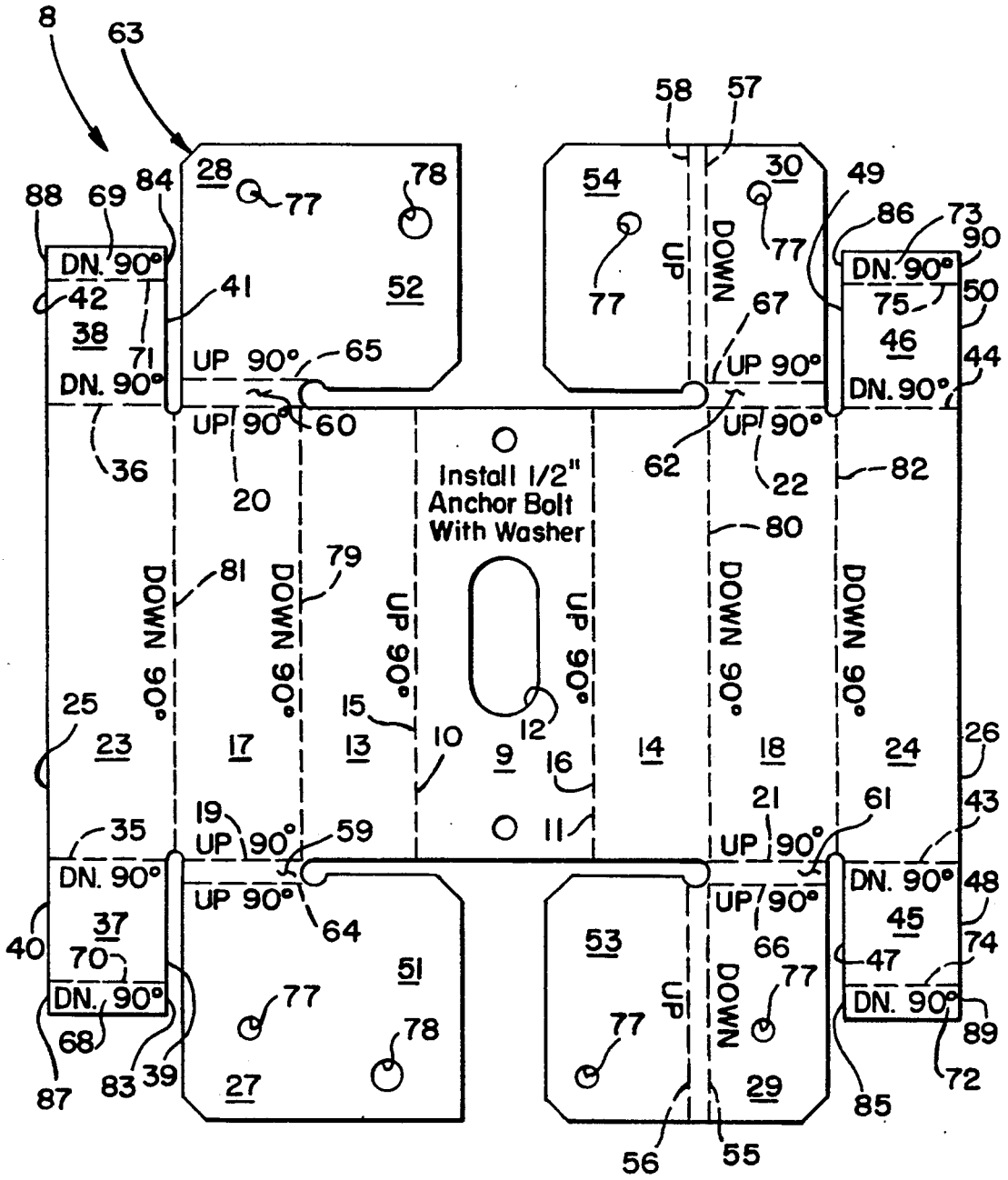
FIG. 7 is a sheet metal blank of the present invention set forth in FIG. 1.

Further strengthening of the supporting capacity of the foundation connector 8 may be achieved by forming first and second outer leg return members 37 and 38 with extensions 68 and 69 which are joined thereto at acute angles by bending along bend lines 70 and 71 as illustrated in FIG. 7. In like manner third and fourth outer leg return members 45 and 46 are formed with extensions 72 and 73 joined thereto at acute angles along bend lines 74 and 75. Extensions 68, 69, 72, and 73, respectively provide upper edges 83, 84, 85, and 86, and lower edges 87, 88, 89, and 90.

Lateral adjustment of the foundation connector 8 relative to anchor bolt 31 is achieved by forming bolt opening 12 in base member 9 as an obround opening. Thus the foundation connector 8 may be shifted laterally as indicated by double headed arrow 91 before tightening nut 33 on threaded portion 32 of anchor bolt 31, and by rotating the foundation connector 8 360°, the foundation connector 8 may be shifted laterally in a lateral direction over an infinite space within the bounds of the length of the obround opening 12. A standard round washer 76 dimensioned to receive anchor bolt 31 therethrough and to prevent movement of threaded nut 33 through obround opening 12 and is positioned between threaded nut 33 and base member 9.

Automatic nailing guns are capable of piercing the metal and attaching the foundation connector 8 to the wood member 4, but preferably first, second, third, and fourth post connection members 27, 28, 29, and 30, and extensions 53, and 54 are formed with fastener openings 77 for receiving fasteners 34 therethrough. Preferably, openings 78 are enlarged in extensions 51 and 52 to allow for some misalignment between extensions 51 and 52 and overlapped extensions 53 and 54.

The foundation connector 8 may be constructed from a single 16 gauge galvanized piece of sheet metal approximately $7\frac{1}{4} \times 7\frac{3}{4}''$. The foundation connector 8 may be formed on an automatic machine and the folding may proceed in an order determined by the tooling. The following description of folding is not necessarily the order used.

First and second inner leg members 13 and 14 are created by bending up 90° along bend lines which are coincident with first and second side edges 10 and 11. First and second support seat members 17 and 18 are formed by bending down 90° along bend lines 79 and 80, and down 90° along bend lines 81 and 82.

To accommodate dimensional lumber, first post connection member 27 is bent up 90° along a bend line which is coincident with first end edge 19, second post connection member 28 is bent up 90° along a bend line which is coincident with second end edge 20, third post connection member 29 is bent up 90° along a bend line which is coincident with second end edge 22, and fourth post connection member 30 is bent up 90° along a bend line which is coincident with second end edge 22.

To accommodate rough sawn lumber which is dimensionally larger than dimensional lumber, the foregoing first, second, third and fourth post connection members 27, 28, 29, and 30 are bent up 90° along bend lines 64–67.

To give extra columnar strength and to shield the base from intrusion of foreign objects beneath the foundation connector 8, first outer leg return member 37 should be bent down 90° along a bend line which is coincident with first end edge 35, and extension 68 may be bent down 90° along bend line 70; second outer leg return member 38 should be bent down 90° along a bend line which is coincident with second end edge 36, and extension 69 may be bent down 90° along bend line 71; third outer leg return member 45 should be bent down 90° along a bend line which is coincident with first end edge 43, and extension 72 may be bent down 90° along bend line 74; and fourth outer leg return member 46 should be bent down 90° along a bend line which is coincident with second end edge 44, and extension 73 may be bent down 90° along bend line 75.

I claim:

1. A post to foundation connection comprising:

a. a concrete foundation having an upper support surface;

b. a wood member mounted in an upright position having first and second sides and a base;

c. a unitary foundation connector constructed from a sheet metal blank of uniform thickness including:

1. a base member disposed in registration with said upper support surface of said concrete foundation having first and second side edges and formed with a bolt opening, 2. first and second inner leg members joined respectively to said first and second side edges of said base member and positioned in a generally upright manner providing first and second inner foot edges in registration with said upper support surface of said concrete foundation, 3. first and second post support seat members elevated above said base member and joined respectively to said first and second inner leg members and disposed in registration with said base of said wood member, and having first and second end edges, 4. first and second outer leg members joined respectively to said first and second post support seat members and having first and second outer foot edges in contact with said upper support surface of said concrete foundation, 5. first and second post connection members respectively joined to said first and second end edges of said first post support seat member and disposed upwardly in registration respectively with said first and second sides of said wood member, 6. third and fourth post connection members respectively joined to said first and second end edges of said second post support seat member and disposed upwardly in registration respectively with said first and second sides of said wood member, d. an anchor bolt embedded in said concrete foundation and having a threaded end inserted through said bolt opening in said base member;

e. a threaded nut dimensioned for threadable attachment to said threaded end of said anchor bolt for clamping registration with said base member; and f. fastener means joining said first and second post connection members and said third and fourth post connection members to said wood member.

2. A post to foundation connection as described in claim 1 comprising:

a. said first outer leg member has first and second end edges;

b. first and second outer leg return members joined respectively to said first and second end edges of said first outer leg member at an angle of at least approximately 90°;

c. said first outer leg return member is formed with an upper edge positioned below and in close proximity to said first post support seat member and adjacent said first end edge of said first post support seat member, and a lower edge in registration with said upper support surface of said concrete foundation;

d. said second outer leg return member is formed with an upper edge positioned below and in close proximity to said first post support seat member and adjacent said second edge of said first support seat member, and a lower edge in registration with said upper support surface of said concrete foundation;

e. said second outer leg member has first and second end edges;

f. third and fourth outer leg return members joined respectively to said first and second end edges of said second outer leg member at an angle of at least approximately 90°, g. said third outer leg return member is formed with an upper edge positioned below and in close proximity to said second post support seat member and adjacent said first end edge of said second post support seat member, and a lower edge in registration with said upper support surface of said concrete foundation, h. said fourth outer leg return member is formed with an upper edge positioned below and in close proximity to said second post support seat member and adjacent said second edge of said second post support seat member, and a lower edge in registration with said upper support surface of said concrete foundation; and i. said bolt opening in said base member is an elongated slot having a length greater than its width.

3. A post to foundation connection as described in claim 1 comprising:

a. said first and third post connection members are dimensioned so that they overlap; and b. said second and fourth post connection members are dimensioned so that they overlap.

4. A post to foundation connection comprising:

a. a concrete foundation having an upper support surface;

b. a wood member mounted in an upright position having first and second sides and a base;

c. a foundation connector including:

1. a base member disposed in registration with said upper support surface of said concrete foundation having first and second side edges and formed with a bolt opening, 2. first and second inner leg members joined respectively to said first and second side edges of said base member and positioend in a generally upright manner providing first and second inner foot edges in registration with said upper support surface of said concrete foundation, 3. first and second post support seat members joined respectively to said first and second inner leg members and disposed in registration with said base of said wood member, and having first and second end edges, 4. first and second outer leg members joined respectively to said first and second post support seat members and having first and second outer foot edges in contact with said upper support surface of said concrete foundation, 5. first and second post connection members respectively joined to said first and second end edges of said first post support seat member and disposed upwardly in registration respectively with said first and second sides of said wood member, 6. third and fourth post connection members respectively joined to said first and second end edges of said second post support seat member and disposed upwardly in registration respectively with said first and second sides of said wood member, d. an anchor bolt embedded in said concrete foundation and having a threaded end inserted through said bolt opening in said base member;

e. a threaded nut dimensioned for threadable attachment to said threaded end of said anchor bolt for clamping registration with said base member;

f. fastener means joining said first and second post connection members and said third and fourth post connection members to said wood member, g. a first end edge extension joined to and coplanar with said first post support seat member and extending said first end edge outwardly for receiving a larger cross sectional dimension wood member;

h. a second end edge extension joined to and coplanar with said first post support seat member and extending said second end edge outwardly for receiving a larger cross sectional dimension wood member;

i. a third end edge extension joined to and coplanar with said second post support seat member and extending said first and edge outwardly for receiving a larger cross sectional dimension wood member; and j. a fourth end edge extension joined to and coplanar with said second post support seat member and extending said second end edge outwardly for receiving a larger cross sectional dimension wood member.

5. A post to foundation connection comprising:

a. a concrete foundation having an upper support surface;

b. a wood member mounted in an upright position having first and second sides and a base;

c. a foundation connector including:

1. a base member disposed in registration with said upper support surface of said concrete foundation having first and second side edges and formed with a bolt opening, 2. first and second inner leg members joined respectively to said first and second side edges of said base member and positioned in a generally upright manner providing first and second inner foot edges in registration with said upper support surface of said concrete foundation, 3. first and second post support seat members joined respectively to said first and second inner leg members and disposed in registration with said base of said wood member, and having first and second end edges, 4. first and second outer leg members joined respectively to said first and second post support seat members and having first and second outer foot edges in contact with said upper support surface of said concrete foundation, 5. first and second post connection members respectively joined to said first and second end edges of said first post support seat member and disposed upwardly in registration respectively with said first and second sides of said wood member, 6. third and fourth post connection members respectively joined to said first and second end edges of said second post support seat member and disposed upwardly in registration respectively with said first and second sides of aid wood member, d. an anchor bolt embedded in said concrete foundation and having a threaded end inserted through said bolt opening in said base member;

e. a threaded nut dimensioned for threadable attachment to said threaded end of said anchor bolt for clamping registration with said base member;

f. fastener means joining said first and second post connection members and said third and fourth post connection members to said wood member g. said first outer leg member has first and second end edges;

h. first and second outer leg return members joined respectively to said first and second end edges of said first outer leg member at an angle of at least approximately 90°;

i. said first outer leg return member is formed with an upper edge positioned below and in close proximity to said first post support seat member and adjacent said first end edge of said first post support seat member, and a lower edge in registration with said upper support surface of said concrete foundation;

j. said second outer leg return member is formed with an upper edge positioned below and in close proximity to said first post support seat member and adjacent said second edge of said first support seat member, and a lower edge in registration with said upper support surface of said concrete foundation;

k. said second outer leg member has first and second end edges;

l. third and fourth outer leg return members joined respectively to said first and second end edges of said second outer leg member at an angle of at least approximately 90°;

m. said third outer leg return member is formed with an upper edge positioned below and in close proximity to said second post support seat member and adjacent said first end edge of said second post support seat member, and a lower edge in registration with said upper support surface of said concrete foundation;

n. said fourth outer leg return member is formed with an upper edge positioned below and in close proximity to said second post support seat member and adjacent said second edge of said second post support seat member, and a lower edge in registration with said upper support surface of said concrete foundation, o. said first and second outer leg return members are formed with extensions joined thereto at an acute angle; and p. said third and fourth outer leg return members are formed with extensions joined thereto at an acute angle.

6. A post to foundation connection as described in claim 5 comprising:

a. said bolt opening in said base member is an obround opening permitting lateral adjustment of said foundation connector relative to said embedded anchor bolt.

* * * * *

UNITED STATES PATENT AND TRADEMARK OFFICE

CERTIFICATE OF CORRECTION

PATENT NO. : 5,333,435

DATED : August 2, 1994

INVENTOR(S) : William F. Leek

It is certified that error appears in the above-identified patent and that said Letters Patent is hereby corrected as shown below:

Column 3, line 29, after the words "52 to present a" delete "coplariat" add ---coplanar---

Column 3, line 39, after the words "59 joined to and" delete "coplariat" add ---coplanar---

Column 6, line 48, after the words "base member and" delete "positioend" add --- positioned---

Column 7, line 23, before the words "edge outwardly for" delete "and" add ---end---

Signed and Sealed this

Eleventh Day of October, 1994

*Attest:*

*Attesting Officer*

Bruce Lehman

BRUCE LEHMAN

*Commissioner of Patents and Trademarks*